US006198460B1

(12) United States Patent
Brankovic

(10) Patent No.: US 6,198,460 B1
(45) Date of Patent: Mar. 6, 2001

(54) ANTENNA SUPPORT STRUCTURE

(75) Inventor: Veselin Brankovic, Fellbach (DE)

(73) Assignee: Sony International (Europe) GmbH, Köln-Ossendorf (DE)

( * ) Notice: Subject to any disclaimer, the term of this patent is extended or adjusted under 35 U.S.C. 154(b) by 0 days.

(21) Appl. No.: 09/248,072

(22) Filed: Feb. 10, 1999

(30) Foreign Application Priority Data

Feb. 12, 1998 (EP) ..... 98102456

(51) Int. Cl.[7] ..... H01Q 21/00

(52) U.S. Cl. ..... 343/879; 343/700 MS; 343/878

(58) Field of Search ..... 343/700 MS, 880, 343/881, 882, 915, DIG. 2, 878, 875, 879, 890, 891, 892; H01Q 21/00

(56) References Cited

U.S. PATENT DOCUMENTS

| | | | |
|---|---|---|---|
| 4,380,013 | 4/1983 | Slysh | 343/753 |
| 5,642,122 | 6/1997 | Lockie et al. | 343/881 |
| 5,969,689 * | 10/1999 | Martek et al. | 343/758 |

FOREIGN PATENT DOCUMENTS 0 752 779 1/1997 (EP) .

OTHER PUBLICATIONS

Patent Abstracts of Japan vol. 097, No. 009, Sep. 30, 1997 & JP 09 118300 A (Toshiba Corp), May 6, 1997.

Nikula, Malkamaki: "High bit rate services for UMTS using wideband TDMA carriers" 1996 IEEE International Conference on Universal Personal Communications, Sep. 29, 1996–Oct. 2, 1996, New York, US, pp. 562–566, XP002071479.

Gudmundson et al.: "Evolution of the GSM air interface into wideband services" IEE Colloquium on Advanced TDMA Techniques and Applications, Oct. 28, 1996, New York, US, pp. 2/1–5, XP002071480.

* cited by examiner

*Primary Examiner*—Hoanganh Le
(74) *Attorney, Agent, or Firm*—Frommer Lawrence & Haug, LLLP.; William S. Frommer; Bruno Polito

(57) ABSTRACT

According to the present invention an antenna support structure for at least three directional antenna sub-systems provided, wherein the antenna sub-systems can be preferably planar antenna arrays. The antenna support structure (1) comprises at least four panels (3, 4) adapted to support respectively one of the antenna sub-systems (2). The panels (3, 4) include a main panel (3) and at least three secondary panels (4) respectively adjacent to the main panel (3). The secondary panels (4) can be respectively attached by hinge means (5) to the main panel (3). Therefore the secondary panels (4) can be individually adjusted in a predetermined angle to the main panel (3). The antenna support structure according to the present invention can be particularly used in combination with wide-band printed dipole antennas for micro-wave and millimeter-wave applications.

14 Claims, 7 Drawing Sheets

Figure 5:
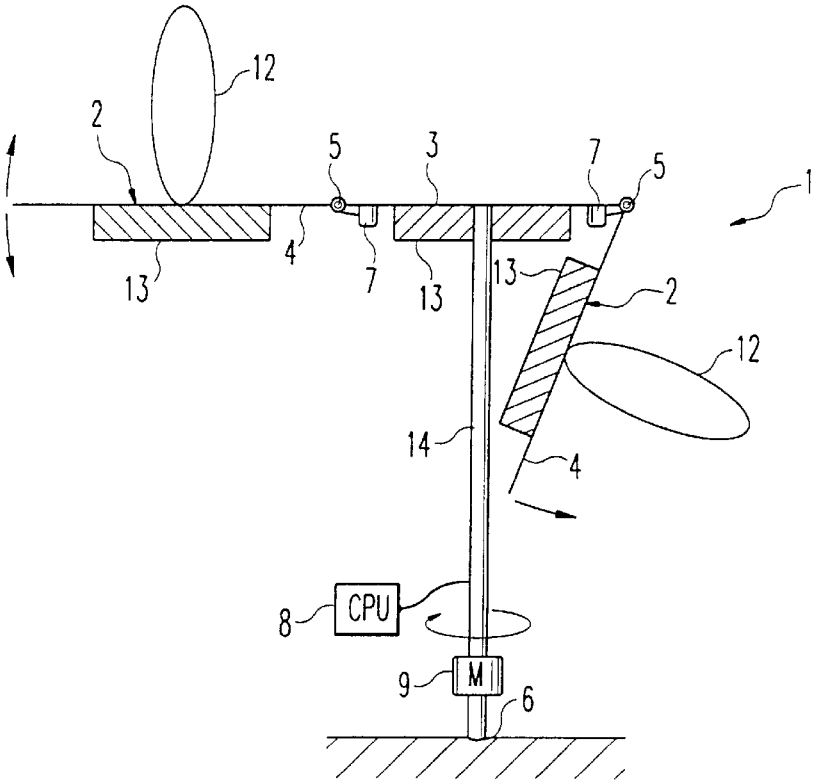

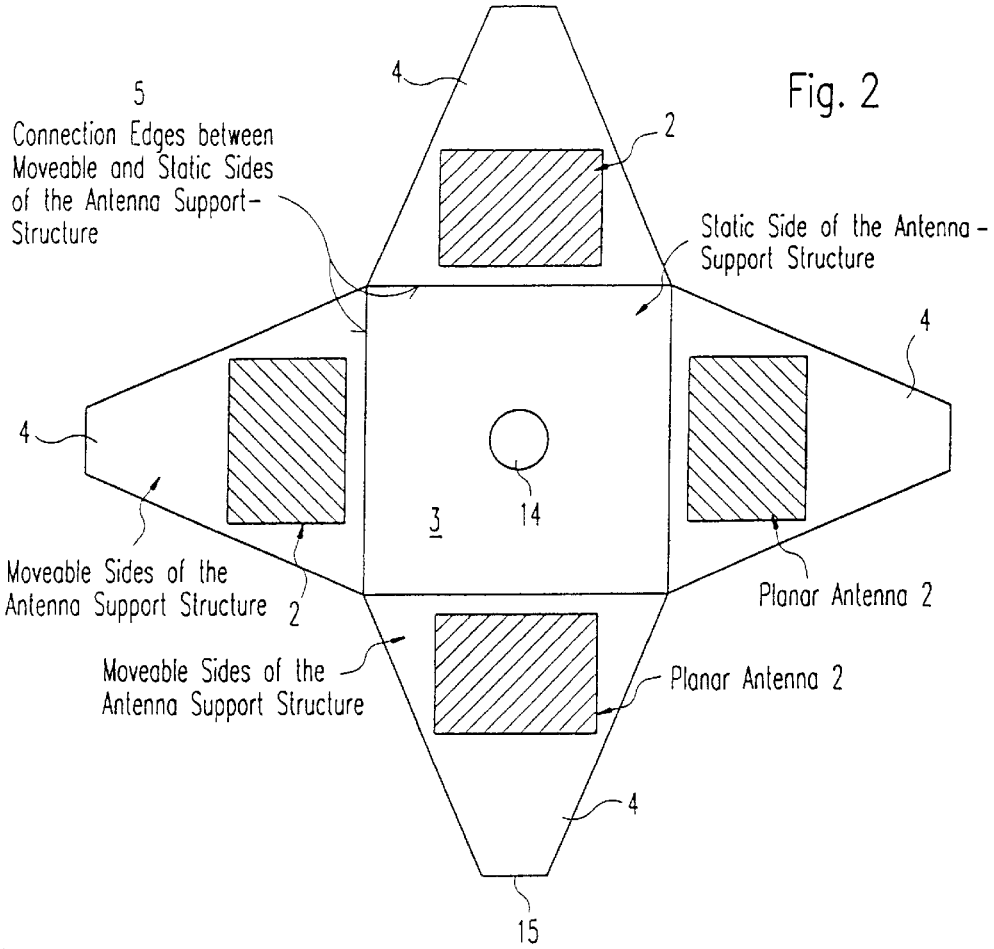
Fig. 2
5
Connection Edges between Moveable and Static Sides of the Antenna Support-Structure
4
2
Static Side of the Antenna-Support Structure
4
4
3
14
Moveable Sides of the Antenna Support Structure
2
Planar Antenna 2
Moveable Sides of the Antenna Support Structure
Planar Antenna 2
4
15

Figure 4:
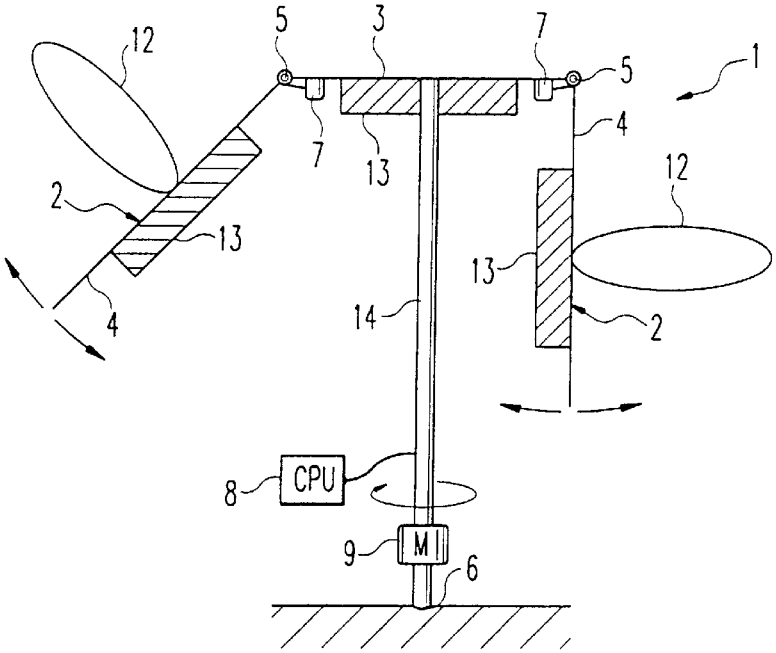

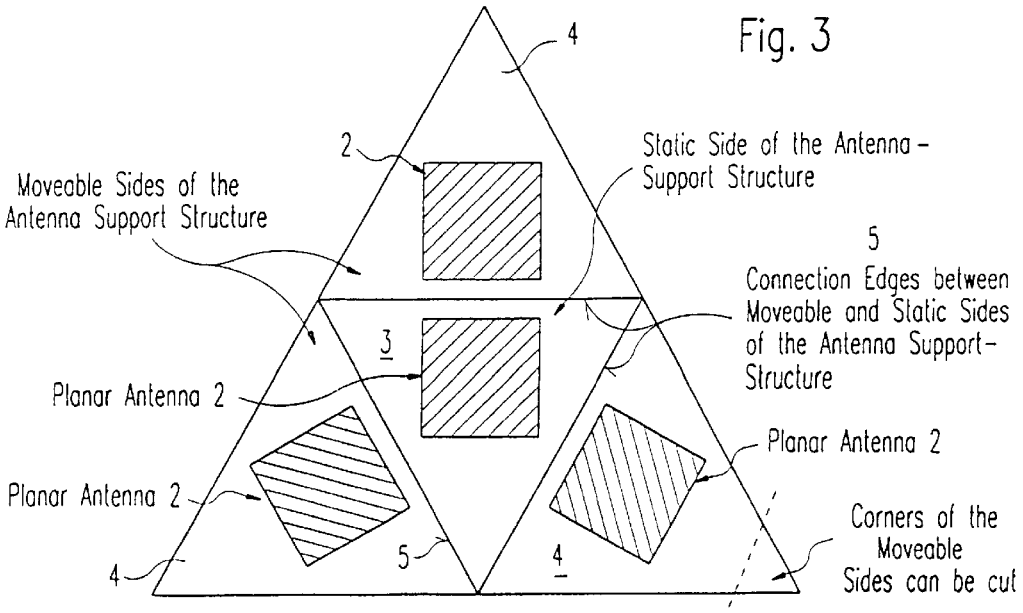
Fig. 3
4
2
Static Side of the Antenna-Support Structure
Moveable Sides of the Antenna Support Structure
5
Connection Edges between Moveable and Static Sides of the Antenna Support-Structure
3
Planar Antenna 2
Planar Antenna 2
Planar Antenna 2
Corners of the Moveable Sides can be cut
4
5
4

ANTENNA SUPPORT STRUCTURE

The present application relates to an antenna support structure particularly for in-door applications as well as to a wireless indoor communication system using such an antenna support structure.

Wireless indoor communication systems according to the state of the art usual use omnidirectional antennas, which are not well suited in the case of communication between different floors, and which are radiating electromagnetic power in all directions. Therefore a part of the radiated electromagnetic power gets always lost, produced multipath effects and interferes with other independent communication systems in the neighborhood.

However, the use of high frequencies for in-door communication systems represents an attractive solution for wireless in-door communication. The user requirements for in-door applications are still growing due to the availability of data and digital video services. The availability of larger bandwidths of data and digital video services. The availability of larger bandwidths at frequency higher than 1 GHz offers a high data rate applications. Frequency bands of 2,4 GHz, 5 to 6 GHz, 24 GHz, 17 GHz, 19 GHz, 40 GHz, and 60 GHz among others are considered throughout the world as to be a possible carrier for modulated transmission signals.

The propagation in in-door environments is usually divided in two groups: light of sight (LOS) communication and non-light of sight (NLOS) communication. The frequencies above 10 GHz are usually considered to be more suitable for LOS communication because of the higher physical attenuation (propagation properties) of the higher carrier frequencies.

The critical components of high frequency systems are the antennas. They can significantly increase of decrease the performance of the entire in-door communication system. In the case of higher frequency (higher than 10 GHz) the number of antenna radiation sub-elements can be larger so that theoretically multi-element arrays can be applied, wherein classic phased arrays, adaptive antennas or smart antennas can be used. At lower frequencies the number of the applied antenna elements has to be decreased due to the larger geometrical size of the radiation elements. A typical working scenario within one cell in the case of NLOS communication includes communication between different rooms which can also be a different floor levels, as it is shown in FIG. 1.

Figure 1:
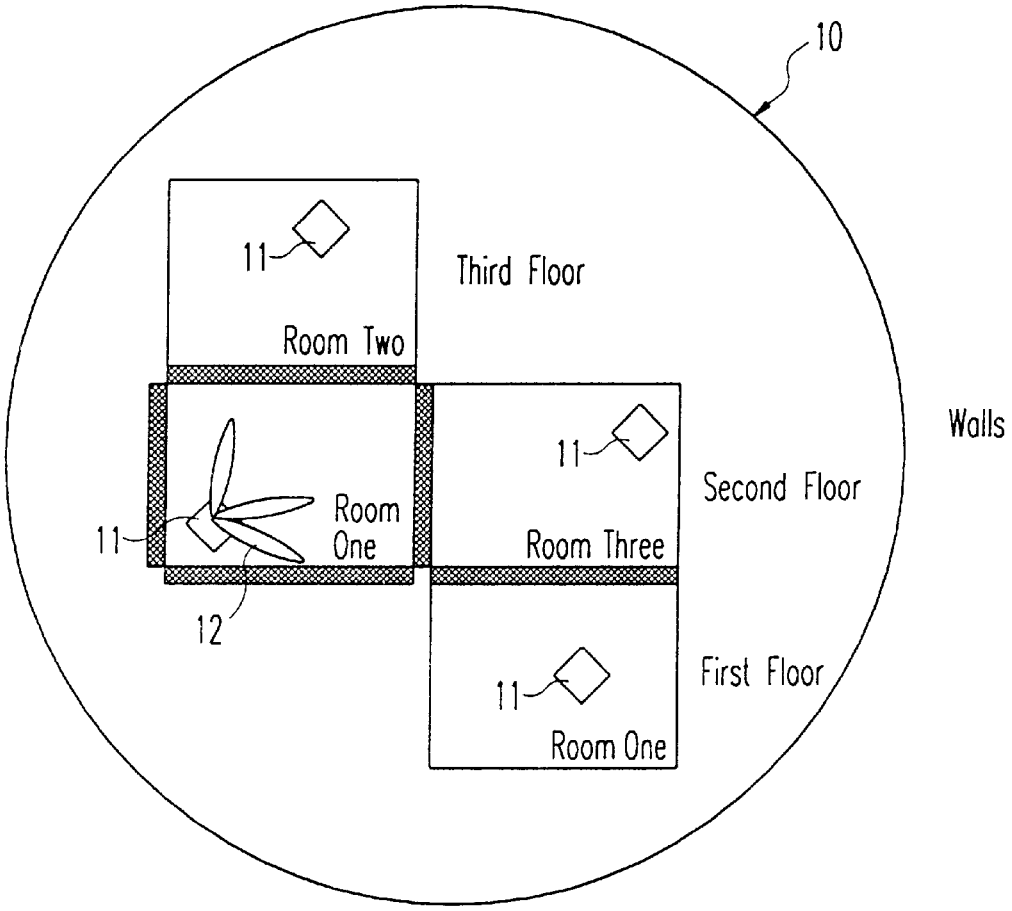

In FIG. 1 the reference number 10 designates one cell of a wireless in-door communication system. In every room of the different floors at least one mobile portable terminal 11 is placed. The four rooms shown in FIG. 1 are belonging to the same wireless in-door cell, which can be for example a private network. To enable the terminal 11 in room 1 to communicate with the other mobile or portable terminals 11 in respectively the other rooms, the antenna loops (beams) 12 of the antenna system associated with the terminal in room 1 has to be directed in all of the directions respectively to the other mobile or portable terminals 11 in the other rooms.

According to the scenario as shown in FIG. 1 it is very likely that communication between different floors can have a big importance, particularly if the used frequency is below 10 GHz. The scenario in FIG. 1 can represent a local high data rate communication system. Due to the very complex propagation properties in the NLOS working case in due to the relatively large wall attenuation and limited transmission power, the proper choice of the antenna system has an crucial importance, particularly if so-called ISM (Industrial, Scientific, Medical) bands with restricted transmission power are considered. Resulting from a simple theoretical consideration it follows that an antenna gain of 7 to 12 dB (printed antennas, 1 or 2 couples of printed radiation elements) instead of the antenna gain of 0–1 dB (classic monopole metal like antennas) can significantly improve the quality of the communication of the wireless in-door communication system, and allow a larger back-off of the transmitter, which is necessary if specific modulation schemes like OFDM or other spread spectrum modulation schemes are used.

Thereby one problem is how to direct the in-door antenna system to the directions such as to have the maximum system gain. The approach of using electrically scanned antennas is theoretically very attractive, however, in practice this approach can not provide for optimum solution for an in-door use as a lot of radiation elements are needed for a good scanning. However, in in-door use there might not be enough place considering the used wavelength. Furthermore such electrically scanned antennas according to the state of the art are expensive and the scanning angles are very limited.

Antennas for in-door communication systems according to the state of the art are usually monopole antennas having an omni directional vertical polarization, or they are based on different microstrip technologies with planar assemblies. A typical product as it is known from the state of the art is for example shown in an advertising folder "The Suhner planar antenna wireless communication in the 1,7–2,5 GHz range" of Huber+Suhner AG, Radio Transmission Department, Herisau, Switzerland. Said known 2,4 GHz (ISM band) planar antenna as a linear and circular polarization.

Furthermore radio LAN an antennas for 5,8 GHz (ISM band) have been proposed. Both proposed antennas have in common that their radiation zone is fixed, once the antennas are mechanically screwed or glowed to a base surface. However, due to the complicated propagation properties in in-door environments it is difficult to predict directly the optimum direction, and it can be desirable to transmit and radiate in some specific direction, e.g. to radiate in one time slot in one direction to a target user in the upper floor to communicate in another time slot with another user who is placed in one of the rooms in the neighborhood, which requires an horizontal radiation pattern.

The object of the present application is to provide for an antenna support structure particularly to support a plurality of planar antenna sub-systems. The preferred application of the proposed antenna support structure lies in the field of in-door wireless transmission systems.

The object of the invention is achieved by means of the features of claim 1.

According to the present invention therefore an antenna support structure for at least three directional antenna subsystems is proposed. The antenna support structure thereby comprises at least four panels adapted to support respectively one of the antenna subsystems. The panels include a main panel as well as at least three secondary panels being placed respectively adjacent to the main panel. The secondary panels are attached by hinge means to the main panel. Thereby the secondary panels can be individually adjusted in a predetermined angle to the main panel.

The main panel can be rotatable relatively to a base point of the antenna support structure.

The antenna sub-system can be preferably planar antenna arrays.

Furthermore electrical and/or mechanical adjustment means can be provided to adjust and fixed respectively the angle between one of the secondary panels and the main panel.

An antenna control unit can be provided controlling the electrical adjustment means. the mechanical adjustment means can be used for a coarse positioning by the user.

The main panel can be adapted to support an antenna sub-system, for example a planar antenna sub-system array.

The main panel can have a triangular shape and one of the secondary panels can be respectively hinged to one of the sides of the main panel.

The secondary panels can also have a triangular shape.

Alternatively the main panel can have an essentially rectangular shape.

Furthermore mechanical and/or electrical rotation drive means for adjusting and fixing the rotation angle of the main panel relatively to the base point of the antenna support structure can be provided.

The hinge means connecting respectively a secondary panel to the main panel can be adapted to provide for a transmission for electrical signal from the main panel each of the secondary panels.

Antenna reflectors can be provided on the back side of at least the secondary panels.

Furthermore according to the present invention wireless in-door communication network for high frequency bands is provided, wherein the wireless in-door communication network comprises a plurality of f.e. mobile terminals, each terminal being connected with an antenna system comprising an antenna support structure as set forth above.

The present invention furthermore relates to the use of an antenna support structure as set forth above, wherein the antenna covers a frequency range of 5 to 6 GHz.

The present invention and further characteristics and advantages thereof will now be explained by means of different embodiments of the present invention and with reference to the annexed figures of the drawings.

Figure 6:
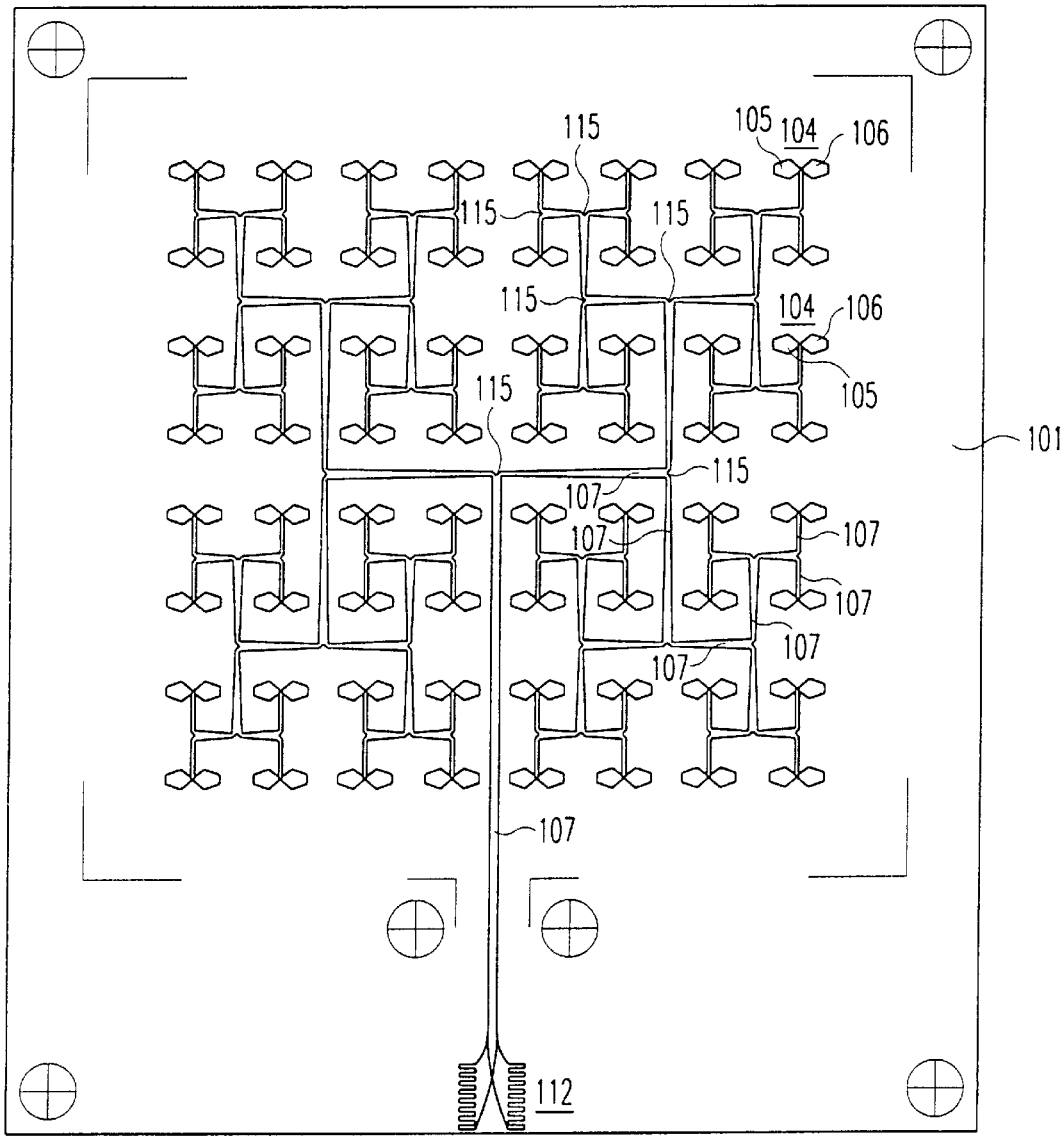
Figure 7:
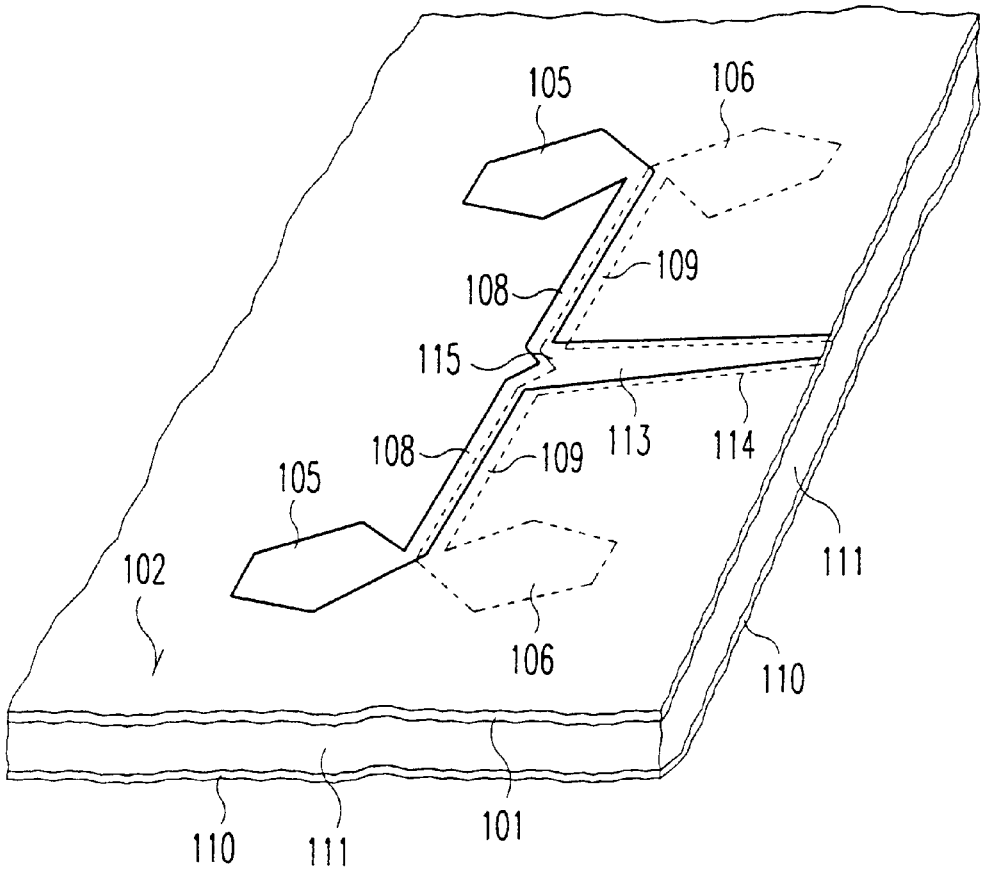
Figure 8:
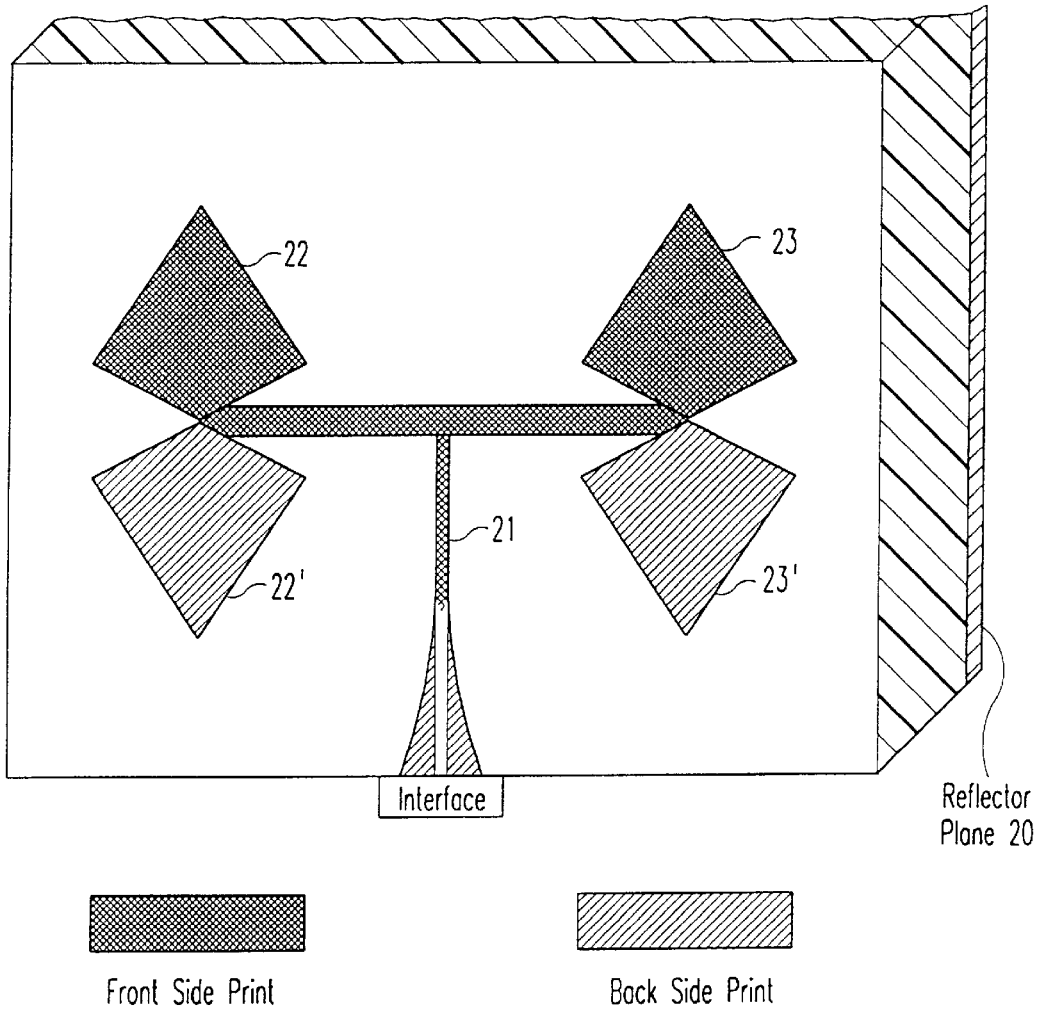
Figure 9:
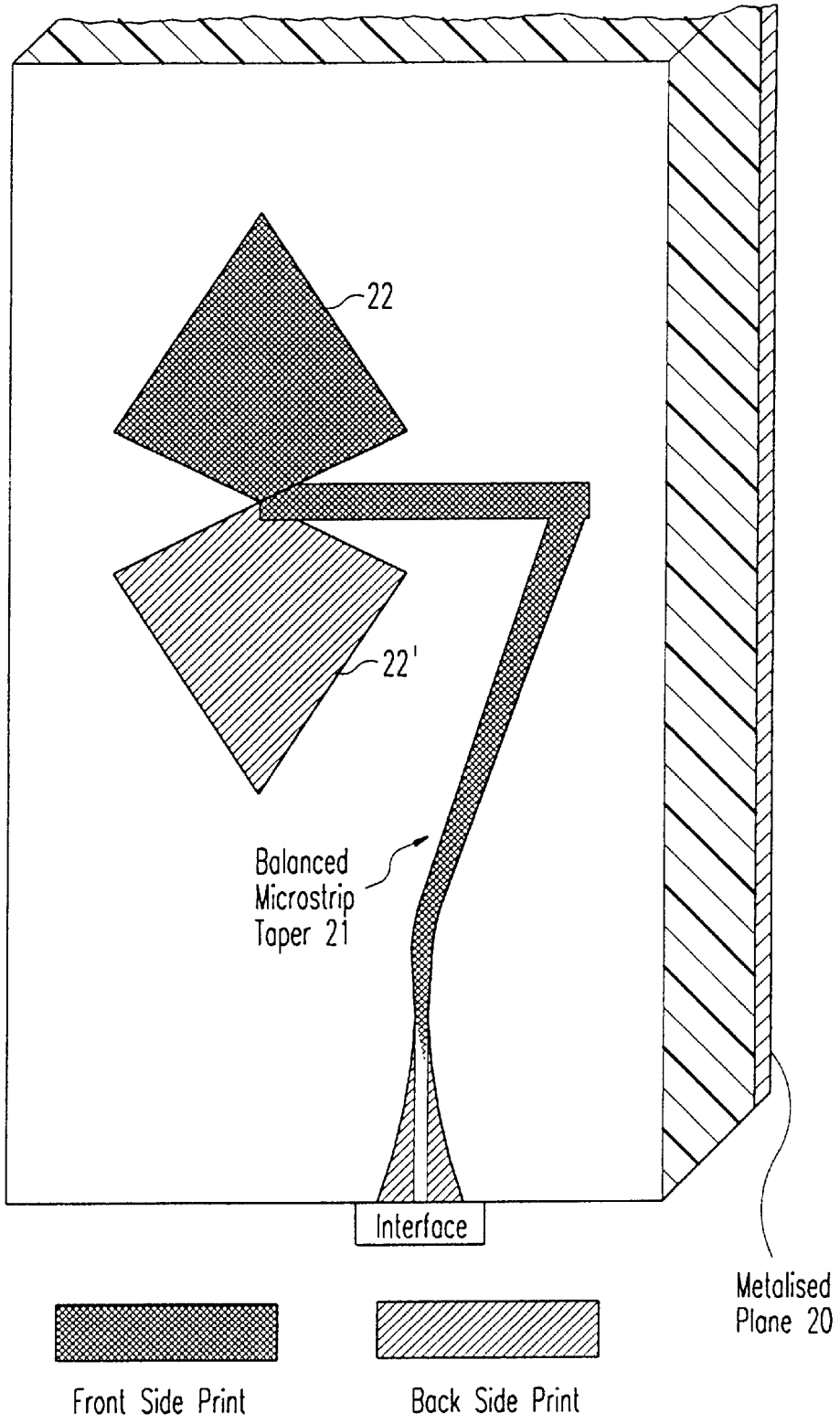

FIG. 1 shows a cell of a wireless high frequency in-door communication system as a typical application scenario of the present invention, FIG. 2 shows the general appearance in a view from above of an antenna support assembly having a pyramidal outlook according to a first embodiment of the invention, FIG. 3 shows the general outlook in a view from above of an antenna support assembly according to a second embodiment of the present invention and having a tetrahedron shape, FIG. 4 shows a side elevation view of an antenna support structure according to the present invention, FIG. 5 shows a side elevation view of an antenna support structure according to another embodiment of the present invention, FIG. 6 shows a schematic upper view of an antenna sub-system finding application in the present invention and having a plurality of dipoles projected in the same plane, FIG. 7 shows a perspective view of a portion of the antenna sub-system finding application in the present invention and having two dipole elements, FIG. 8 shows generally another printed antenna having two broadband dipoles and which finds its application in the present invention, and FIG. 9 shows generally still another printed antenna having one broadband dipole and which find its application in the present invention.

An wireless in-door transmission (communication) system comprises a plurality, f.e. four or more antenna sub-systems which can be addressed separately in the way of classic antenna diversity systems (for example the highest RF signal field strength can be a criterion for switching from one of the antenna sub-systems to another). Furthermore according to the present invention small adaptive antennas (using additional face shifters in the RF chain and RF combining circuits) or smart antennas (using baseband processing of the different channels and baseband combining) can be used, thereby providing for a small beam scan. Finally according to the present invention the users in the different directions can be accessed in different time slots or all of the users can be selected to be accessed in different directions in the same slot (e.g. the complete video program will be transmitted by means of the wireless transmission system according to the present invention in the upper floor and the right room and front room of the apartment, which means, that the video program will not be radiated on the directionally).

"Antenna subsystem" in the sense of the present invention can be defined as a system having a plurality of antenna elements, with one or more radiation elements with a plurality of polarizations and with or without electrical scanning means. An antenna subsystem can be as a typical example a planar antenna patch.

Taking into account the above items it can be seen that the use of an omni-directional antenna as it is known from the state of the art would lead to a waste of the energy radiated and would furthermore increase unwanted multipath effects and result in higher defense (rejection) mechanisms.

With reference to FIGS. 2 to 5 different embodiments of an antenna support structure according to the present invention will now be explained.

As can be seen from FIG. 2 an antenna support structure according to the present invention comprises a plurality of panels 3,4. A central main panel 3 is provided representing the static side of the antenna support assembly according to the present invention. In the embodiment of FIG. 2 the central main panel 3 of the antenna support structure has an essentially quadratic shape. On each peripheral side of the main panel 4 respectively one movable secondary panel 4 is attached. The connection between respectively one of the plurality of secondary movable panels 4 and the main central panel 3 is effected by means of hinge or pivotal means 5. By means of the hinge means 5 the secondary panels 4 can assume an arbitrary angle relatively to the main panel 3. The angle between respectively one of the secondary panels 4 and the main panel 3 can be adjusted and then be fixed.

In the embodiment of FIG. 2 the secondary panels 4 have an essentially triangular shape, wherein the outer edge 15 of the triangular secondary panels 4 can be cut off. As will be explained later with reference to FIG. 4 and 5 a rotation stub 14 can be attached to the main panel 3, wherein the rotation stub 14, which provides for a rotational degree of freedom of the main panel 3 and therefore of the whole antenna support structure, is fixed on a base structure of the antenna support structure 1, for example on a wall, a ceiling or the floor of a room.

FIG. 3 shows another embodiment of the present invention. As can be seen from FIG. 3, the essential difference between the embodiment of FIG. 3 and FIG. 2 lies in the geometrical shape of the main panel 3. According to the embodiment of FIG. 3 the main panel 3 has a triangular shape and therefore three triangular secondary panels 4 are attached by hinge means 5 respectively to one side of the triangular main panel 3, In the embodiments of FIG. 2 respectively one directive (planar) antenna sub-system 2 is supported by a secondary panel 4. In FIG. 3 respectively one planar antenna sub-system 2 is supported by a secondary panel 4, however, in the embodiment of FIG. 3 a planar antenna sub-system 2 is added to the upper surface of the main panel 3.

Also in the case of the embodiment according to FIG. 3 the outer corners of the secondary panels 4 can be cut off to reduce the outer dimensions of the antenna support structure.

FIG. 4 shows a side elevation view of an embodiment of the present invention. Two secondary panels 4 are shown which are attached by hinge means 5 to the main panel 3. Respectively one planar antenna sub-system 2 is attached to the upper surface of respectively one of the secondary panels 4. The radiation lobes (beams) of the planar antenna sub-systems 2 are designated with the reference signs 12. The angles between respectively one of the secondary panels 4 and the central main panel 3 can be adjusted in the desired position and fixed by electrical adjustment means 7, which can be for example an electric motor 7. As an alternative or additionally mechanical adjustment means can be provided.

Therefore the direction of the radiation lobes (beams) 12 of the directive antenna subsystems 2 can be orientated in any desired direction.

On the backside of each of the secondary panels 3 and the main panel 4 a reserved space 13 is provided for RF front and amplifiers and/or antenna reflectors and/or cables and connectors.

The hinge means 5 can furthermore serve as transmission means for electrical communication, as for example base-band signals from the antenna sub-systems 2, RF signals, basing voltage by means of plurality of transmission lines etc. between the front and amplifiers on the backside 13 of the secondary panels 4 and the main panel 4 of the antenna support structure 1.

The positions (angles) of the secondary panels 4 can therefore be mechanically and/or electrically adjusted and fixed in a desired position, which adjustment and fixation can be controlled automatically by an antenna control unit, which is represented as a CPU 8 in FIG. 4 and 5. The main panel 3 and therefore the entire antenna support structure is supported by a rotation stub 14, which supports on one of its ends the main panel 3 and which is attached on the other one of its ends at the basepoint 6 of the antenna support structure for example to the wall of a room. The rotation stub 14 can be rotated relatively to the basepoint 6 for example by means of an electric motor 9. Said electric motor 9 can also be controlled by the antenna control unit (CPU) 8. Therefore the entire antenna support structure can be rotated about the main axis of the rotation stub 14. The rotation (angle) of the entire antenna support structure can therefore be mechanically and/or electrically adjusted and fixed in a desired position, which adjustment and fixation can be automatically controlled by the antenna control unit (CPU) 8.

FIG. 5 shows the embodiment of FIG. 4, wherein the angles between respectively one secondary panel 4 and the main panel 3 have been adjusted and fixed in another way such as to provide for another antenna radiation pattern as it is defined by the direction of the lobes 12 of the planar antenna sub-systems 2 respectively supported by one of the secondary panels 4.

In the following an antenna type will be explained which can be used preferably in connection with the present invention. The present invention, however, is not limited to this kind of directive planar antenna.

FIG. 6 shows a schematic upper view of an antenna 102 with a projection of metal strip means 107 and a plurality of dipole means 104 from a front face 102 and a back face 103 of the dielectric substrate means 101 in a common plane. In the antenna according to the present invention, the first elements 105 of the dipole means 104 are printed on the front face 102 of the dielectric substrate means 101 and the second elements 106 of the dipole means 104 are printed on the back face 103 of the dielectric substrate means 101. The first elements 105 are connected to each other with a first line 108 supported by the front face 102 for supplying signals to and from the first elements 105. The second elements 106 are coupled to each other with a second line 109 supported by the back face 103 for supplying signals to and from said second elements 106.

In the example shown in FIG. 6, the first line 108 and the second line 109 building the metal strip means 107 have a balanced microstrip structure and are connected to a waveguide transition element 112 near the edge of the dipole antenna 102 to provide a transition between the balanced lines 108 and 109 to a waveguide supplying the signals to be radiated by the dipole means 104. The waveguide transition element 112 consists of two parts connecting each of the lines 108 and 109 to a waveguide. Each of the two parts of the waveguide transition element 112 comprises a plurality of teeth elements arranged perpendicular to the direction of the lines 108, 109 on the front face 102 and the back face 103, respectively. It is to be noted, that future commercial communication systems in microwave and millimeter wave ranges will be based on planar technology, so that other kinds of transition elements will be needed.

In FIG. 6,the first line 108 and the second line 109 respectively printed on the front face 102 and the back face 103 each split into two branches by means of a T-junction 115 located approximately in the middle of the dipole antenna. From the first T-junction 115 located approximately in the middle of the dipole antenna, succeeding T-junctions 115 being respectively rectangular to each other split the first line 108 and the second line 109 into a respective plurality of first line portions 113 and second line portions 114. Each line portion 113 is connecting two adjacent T-junctions 115 and each second line portion 114 is also connecting two adjacent T-junctions 115.

As can be seen from FIG. 6, the structure of the first and second line portions 113, 114 and the succeeding T-junctions 115 is symmetrical for the two branches. Further on, respective adjacent first and second line portions 113 and 114 are rectangular to each other. After the last T-junctions 115, respective end portions of the first line 108 and the second line 109 lead into dipole means 104. Each dipole means 104 comprises a first and a second element 105, 106 for radiating and receiving electromagnetic signals transmitted by the first line 108 and the second line 109. The first elements 105 are printed onto the front face 102 of the dielectric substrate 101 and the second elements 106 are printed onto the back face 103 of the dielectric substrate 101. The first and the second elements 105, 106 respectively extend generally perpendicular to the first or second line portion 113, 114 they are connected with. Further on, the first elements 105 are pointing in a first direction and the second elements 106 are pointing in a second direction which is opposite to that first direction, as can be seen from FIG. 6.

The preferred shape of the first and the second elements 105 and 106 is a pentagonal shape. As can be further seen in FIG. 6, the first line portions 113 and the second line portions 114 between adjacent T-junctions 115 are tapered to provide an impedance transformation in the succeeding T-junction located in direction to the dipole means 104. The first and second line portions 113, 114 are tapered, so that the width of each line portion 113, 114 increases towards that first and second elements.

In FIG. 7, the schematic perspective view of a portion of the antenna shown in FIG. 6 having two dipoles is shown. The antenna comprises a substrate 101 having a front face 102 and a back face 103. The first elements 105 are printed on the front face 102 and the second elements 106 are printed on the back face 103. Also, the first lines 108 are printed on the front face 102 and the second lines 109 are printed on the back face 103. In FIG. 7, only two dipole means 104 are shown, which are fed by first and second lines 108, 109. The T-junction 115 between the two shown dipole means 104 is fed by a first line portion 113 on the front face 102 and a second line portion 114 on the back face 103. The first and the second line portion 113, 114 are tapered with an increasing width towards the dipole means 104. The tapering provides an impedance transition from 100 Ω at the narrow part of the first and the second line portion 113, 114 to 50 Ω at the large part of the first and the second line portion 113, 114. At the T-junction the first and second line portion 113, 114 are split into the not-tapered end portions of the first and the second line 108, 109 leading to the dipole means 104. The low loss material 111 between the dielectric substrate 101 and the reflector means 110 is chosen to have minimum losses and a dielectric constant less than 1.2.

In the shown example, the low loss material 111 is a supporting structure supporting said reflector means 110 and said dielectric substrate on its back face 103. In other embodiments, the loss material 111 can be air, so that a free space exists between the dielectric substrate 101 and the reflector means 110. Advantageously, the low loss material is a polyurethane foam. However, the low loss material can be any other material with a dielectric constant less than 1.2. By a variation of the low loss material 111 the thickness of the antenna can be influenced. In FIG. 7, dashed lines are used to show the second element 106 and the second line 109 being printed on the back face 103 of the dielectric substrate 1.

FIG. 8 shows another printed planar antenna which can find application along with the present invention. FIG. 8 shows an antenna sub-system having two broadband dipoles 22, 22' and 23, 23', respectively. The antenna sub-system as shown in FIG. 8 can cover a frequency range from 5 to 6 GHz for example. As has already been explained above, the printed antenna is fed by means of a balanced micro strip taper 21. Furthermore, a reflector plane 20 made from a metallic material is provided.

FIG. 9 shows another printed antenna solution which can find its application along with the present invention. The antenna shown in FIG. 9 is an antenna sub-system having one broadband dipole 22, 22' and covers preferably the interesting frequency range from 5 to 6 GHz (ISM band).

In the embodiments for an antenna as shown in FIG. 8 and FIG. 9 one pole of the dipoles 22, 22' and 23, 23', respectively, is printed on the front side and the respective other pole is printed on the backside.

The antenna support structure according to the present invention therefore fulfills the requirements as set forth in the introductory portion of the description. The flexibility and the end user oriented approach makes the invention advantageous compared to antenna support structure concepts according to the state of the art. The particular advantage of the present invention is the capability to choose the antenna radiation direction by simply mechanically or electrically/electronically adjusting and optimizing the available transmission resources based on the environment conditions, as for example the outlook of the area to be covered, wherein the possibility of an optimization also for upper and down floors is provided.

As can be seen from FIG. 4 and FIG. 5 the body of the antenna support structure according to the present invention can be adjusted such as to built a cube, wherein the antenna sub-systems 2 are placed on four sides and therefore assuming an angle of 90 degrees respectively to each other.

Though the invention has been explained with reference comprising three or four secondary panels, it is to be understood that taking account the operation conditions of the corresponding antennas, a even higher number of secondary panels and antenna subsystems can be of advantage.

What is claimed is:

1. Antenna support structure for at least three directional antenna subsystems (2), the antenna support structure (1) comprising at least four panels (3, 4) adapted to support respectively one of the antenna subsystems (2), the panels (3,4) including a main panel (3), at least three secondary panels (4) respectively adjacent to the main panel (3), the secondary panels (4) being respectively attached by hinge means (5) to the main panel (3), such that the secondary panels (4) can be individually adjusted in a predetermined angle to the main panel (3); and means for affixing said antenna support structure to an earthbound structure such that said antenna support structure is operational while affixed to said earthbound structure.

2. Antenna support structure according to claim 1, characterized in that the main panel (3) is rotatable relative to a base point (6) of the antenna support structure (1).

3. Antenna support structure according to claim 1, characterized in that the antenna subsystems are planar antenna arrays (2) having at least one patch.

4. Antenna support structure according to claim 1, characterized by electrical and/or mechanical adjustment means (7) being adapted to adjust and fix respectively the angle between one of the secondary panels (4) and the main panel (3).

5. Antenna support structure according to claim 4, characterized by an antenna control unit (8) controlling the electrical adjustment means (7).

6. Antenna support structure according to claim 1, characterized in that the main panel (3) is adapted to support an antenna subsystem (2).

7. Antenna support structure according to claim 1, characterized in that the main panel (3) has a triangular shape and one secondary panel (4) is respectively hinged to one of the sides of the main panel.

8. Antenna support structure according to claim 1, characterized in that the secondary panels (4) have a triangular shape.

9. Antenna support structure according to claim 1, characterized in that the main panel (3) has an essentially rectangular shape.

10. Antenna support structure according to claim 1, characterized by mechanical and/or electrical rotation drive means (9) for adjusting and fixing the rotation angle of the main panel (3) relative to a base point (6) of the antenna support structure (1).

11. Antenna support structure according to claim 1, characterized in that the hinge means (5) are adapted to provide for a transmission of electrical signals from the main panel (3) to each of the secondary panels (4).

12. Antenna support structure according to claim 1, characterized by antenna reflectors (13) and/or space for RF circuitry on the back side of at least the secondary panels (4).

13. Wireless indoor communication network, at least two terminals (11), each terminal (11) being connected with an antenna system comprising an antenna support structure (1) according to claim 1.

14. Use of antenna support structure according to claim 1, for antennas covering a frequency range of 5 to 6 GHz.

* * * * *